US007020407B2

(12) United States Patent
Nakata et al.

(10) Patent No.: US 7,020,407 B2
(45) Date of Patent: Mar. 28, 2006

(54) TRANSFERRING APPARATUS WITH TWO OR MORE VOLTAGE OUTPUT MODES

(75) Inventors: Yasuhiro Nakata, Shizuoka (JP); Hisashi Nakahara, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 115 days.

(21) Appl. No.: 10/778,064

(22) Filed: Feb. 17, 2004

(65) Prior Publication Data

US 2004/0165901 A1 Aug. 26, 2004

(30) Foreign Application Priority Data

Feb. 25, 2003 (JP) ..... 2003-047698

(51) Int. Cl.
*G03G 15/16* (2006.01)

(52) U.S. Cl. ..... 399/66

(58) Field of Classification Search ..... 399/66, 399/314, 99, 101, 297, 310, 313
See application file for complete search history.

(56) References Cited

U.S. PATENT DOCUMENTS 5,196,885 A * 3/1993 Takeuchi et al. ..... 399/66 X
5,420,668 A * 5/1995 Okano ..... 399/66 X
5,467,262 A * 11/1995 Nakata et al. ..... 363/41
5,887,220 A * 3/1999 Nagaoka ..... 399/66 X
5,999,763 A * 12/1999 Hiroshima et al. ..... 399/66
6,035,154 A * 3/2000 Takahata et al. ..... 399/66
6,370,345 B1 * 4/2002 Sasai ..... 399/101
6,381,425 B1 * 4/2002 Sasai ..... 399/66
6,701,101 B1 * 3/2004 Ahn ..... 399/66
2001/0046389 A1 * 11/2001 Kuribayashi et al. ..... 399/66 X

FOREIGN PATENT DOCUMENTS

JP 8-140351 5/1996

* cited by examiner

*Primary Examiner*—Sandra L. Brase
(74) *Attorney, Agent, or Firm*—Fitzpatrick, Cella, Harper & Scinto

(57) ABSTRACT

To provide a transferring apparatus, it is possible to perform switching between a high mode and a low mode in a transfer voltage generator circuit of a transferring apparatus by using a microcomputer. The high mode is a mode in which a positive transfer voltage generator circuit is operated independently, and a voltage generated by the positive transfer voltage generator circuit is output as a transfer voltage. The low mode is a mode in which the positive transfer voltage generator circuit and a negative transfer voltage generator circuit are both operated, and the voltages generated by each of the circuits are superimposed and output as the transfer voltage.

14 Claims, 6 Drawing Sheets

TRANSFERRING APPARATUS WITH TWO OR MORE VOLTAGE OUTPUT MODES

BACKGROUND OF THE INVENTION

1. Field of the Invention

The present invention relates to a transferring apparatus that is used in an image forming apparatus.

2. Related Background Art

A transferring apparatus is used in an image forming apparatus according to an electrophotographic process in order to transfer a toner image borne on an image bearing member, a so-called photosensitive drum, to a transferring material, a so-called sheet. There are several types of apparatuses known as transferring apparatuses.

Among the transferring apparatuses, a system is widely used for transferring a toner image borne on a photosensitive drum to a sheet by applying a transfer voltage to a cylindrical transferring member, a so-called transfer roller, and passing a sheet between the transfer roller and the photosensitive drum. The transfer roller and the photosensitive drum are in contact in this system in a state in which a sheet has not passed between the transfer roller and the photosensitive drum. The sheet therefore remains within the apparatus, and the transfer roller may be contaminated by the toner when the sheet is removed manually, or the like. Accordingly, this system has a function for cleaning the transfer roller by applying a voltage having a polarity opposite to that of the transfer voltage to the transfer roller at a predetermined timing, and rotating the photosensitive drum and the transfer roller.

A circuit that generates a positive transfer voltage and a circuit that generates a negative transfer voltage are provided in a transfer voltage generator circuit. Direct current high voltage output circuits that are structured by an inverter transformer and a rectifying circuit are generally used as the circuits that respectively generate the positive transfer voltage and the negative transfer voltage. A positive electric potential voltage is variably output as the transfer voltage with this type of transfer voltage generator circuit, the voltage varying according to the environment and transfer roller characteristics. On the other hand, an output voltage used when cleaning the transfer roller is a negative voltage in order to achieve a function for promoting the toner to move from the transfer roller to the photosensitive drum. High precision is not demanded for the negative voltage, and therefore variable voltage control is not necessary. The negative voltage is a fixed output voltage.

The transfer voltage generator circuit is explained while referring to FIGS. 6 to 8. FIG. 6 is a schematic diagram that shows a transfer voltage generator circuit for a case where the toner is negative toner, and FIG. 7 shows a pulse waveform that is output from a pulse output port DPLS10 of a microcomputer IC201 of FIG. 6. FIG. 8 is a graph that shows a relationship between an output voltage of a positive transfer voltage generator circuit 202 and a PWM (pulse width modulation) signal output from the microcomputer IC201 of FIG. 6.

A photosensitive drum 105 that is scanned and exposed by a laser light 109 is provided in an image forming apparatus as shown in FIG. 6, and the photosensitive drum 105 is grounded. A charging roller 107, a developing sleeve 108, and a transfer roller 106 are disposed in the periphery of the photosensitive drum 105. Predetermined voltages are applied to the charging roller 107 and to the developing sleeve 108 by a charging voltage generator circuit (not shown) and a developing voltage generator circuit (not shown), respectively. A transfer voltage that is output from the transfer voltage generator circuit 201 is applied to the transfer roller 106.

The photosensitive drum 105 is rotated in a direction of an arrow in FIG. 6 when forming an image, and a surface of the photosensitive drum 105 is charged uniformly to a predetermined electric potential by the charging roller 108. The surface of the photosensitive drum 105 is then scanned and exposed by the laser light 109. An electrostatic latent image is thus formed on the photosensitive drum 105. The electrostatic latent image is then made into a visible image as a toner image by toner supplied from the developing sleeve 108. The toner image borne on the photosensitive drum 105 is transferred by the transfer roller 106 onto a sheet 110 that is nipped and conveyed between the photosensitive drum 105 and the transfer roller 106.

The transfer voltage generator circuit 201 has the microcomputer IC201, the positive transfer voltage generator circuit 202 that generates the positive transfer voltage, a negative transfer voltage generator circuit 103 that generates the negative transfer voltage, and a transfer current detector circuit 104 that detects current flowing in the transfer roller 106. The microcomputer IC201 has two independent output ports DPLS10, one port PWM, and one A/D port CRINT. Pulses having the same waveform are output from the two pulse output ports DPLS10. Both of the waveforms are waveforms having an ON duty of 10%, for example, as shown in FIG. 7. The two pulses serve as drive signals for the positive transfer voltage generator circuit 201 and the negative transfer voltage generator circuit 103, and drive inverter transformers T101 and T102, respectively. Outputs from the inverter transformers T101 and T102 are changed into the positive transfer voltage and the negative transfer voltage through a latter stage quadruple rectifying circuit and a latter stage rectifying circuit, respectively. That is, the microcomputer IC201 turns on the pulse output port DPLS10 that is connected to the positive transfer voltage generator circuit 201 when outputting the positive transfer voltage. The microcomputer IC201 turns on the pulse output port DPLS10 that is connected to the negative transfer voltage generator circuit 103 when outputting the negative transfer voltage.

The PWM port is connected to the positive transfer voltage generator circuit 202, and the A/D port is connected to the transfer current detector circuit 104. A current value detected by the transfer current detector circuit 104 is input to the microcomputer IC201 through the A/D port, and the microcomputer IC201 determines the transfer voltage based on the current value. The PWM signal is changed and sent to the positive transfer voltage generator circuit 202 through the port PWM to obtain the determined transfer voltage. A driver voltage of the transformer T101 of the positive transfer voltage generator circuit 202 is changed according to the PWM signal, and the desired output voltage (transfer voltage) is obtained. For example, a relationship between the output voltage of the positive transfer voltage generator circuit 202 and the value set for the PWM signal is shown in FIG. 8 when the PWM signal is variable to 256 levels.

The positive transfer voltage generator circuit 202 specifically includes a switching portion that drives the transformer T101 based on the pulse signal from the pulse output port DPLS10 of the microcomputer IC201, a constant voltage control portion that controls the switching state of the transformer T101, and a quadruple rectifier portion that rectifies and smoothes the output voltage of the transformer T101. The switching portion is constituted of transistors Q101 and Q102, resistors R101 and R102, a capacitor C202, and a diode D101.

The constant voltage control portion is constituted of a comparative operational amplifier IC 202, a transistor Q201, resistors R201, R202, R203, R204, R205, and R103, and a capacitor C201. A voltage to be input to the comparative operational amplifier IC 202 is generated in the constant voltage control portion based on the PWM signal from the microcomputer IC201. An operation of the transistor Q201 is controlled based on the results of the comparison operation of the comparative operational amplifier IC 202.

The quadruple rectifier portion is constituted of capacitors C101, C102, C103, and C104, diodes D102, D103, D104, and D105, and a resistor R104. The output voltage of the rectifier portion is a positive voltage, and the output voltage is applied to the transfer roller 106, which is a load.

The negative transfer voltage generator circuit 103 specifically includes a switching portion that drives the transformer T102 based on the pulse signal from the pulse output port DPLS10 of the microcomputer IC201, and a rectifier portion that rectifies and smoothes the output voltage of the transformer T102. The switching portion is constituted of transistors Q103 and Q104, and resistors R105, R106, and R107. The resistor R107 is connected to a reference power source (24 V) here, and the output voltage of the transformer T102 is set by the reference power source. The rectifier portion is constituted of a capacitor C105, a diode D107, and a resistor R108. The output voltage of the rectifier portion is a negative voltage, and the output voltage is applied to the transfer roller 106, which is a load.

The transfer current detector circuit 104 detects the value of the current that flows in the transfer roller 106 when the positive output voltage of the positive transfer voltage generator circuit 202 is applied to the transfer roller 106. The detected current value is sent to the microcomputer IC201. The transfer current detector circuit 104 is specifically constituted of a comparative operational amplifier IC102, capacitors C106 and C107, and resistors R109, R110, R111, R112, R113, R114, R115, and R116. Output from the comparative operational amplifier IC102 is input to the microcomputer IC201 as a signal (CRNT) that shows the detected current value.

Further, it is also possible to use a circuit as disclosed in Japanese Patent Application Laid-Open No. H08-140351, which changes a driving frequency of an inverter transformer as the positive transfer voltage generator circuit. A transfer voltage generator circuit that adopts the circuit disclosed in Japanese Patent Application Laid-Open No. H08-140351 as the positive transfer voltage generator circuit is explained while referring to FIGS. 9 to 11. FIG. 9 is a diagram that shows a circuit configuration of a transfer voltage generator circuit that adopts the circuit disclosed in Japanese Patent Application Laid-Open No. H08-140351 as a positive transfer voltage generator circuit. FIG. 10 shows a pulse waveform output from a port DPLSVAR of a microcomputer IC301 of FIG. 9. FIG. 11 is a graph that shows a relationship between an output voltage of a positive transfer voltage generator circuit 102 and the pulse output from the port DPLSVAR of the microcomputer IC301 of FIG. 9. It should be noted that elements shown in FIG. 9 which are identical to the circuits, components, and members shown in FIG. 6 are denoted by the same reference symbols as those used in FIG. 6.

Specifically, the transfer voltage generator circuit 301 has the positive transfer voltage generator circuit 102, the negative transfer voltage generator circuit 103, the transfer current detector circuit 104, and the microcomputer IC301 as shown in FIG. 9. The positive transfer voltage generator circuit 102 includes a switching portion that drives the transformer T101 based on the pulse signal from the port DPLSVAR of the microcomputer IC301, and a quadruple rectifier portion that rectifies and smoothes the output voltage of the transformer T101. The switching portion is constituted of the transistors Q101 and Q102, the resistors R101, R102, and R103, and the diode D101. The resistor R103 is connected to a reference power source (24 V) here, and the output voltage of the transformer T102 is set by the reference power source.

The microcomputer IC301 has the port DPLSVAR for outputting a pulse with a variable frequency and fixed on-time, one pulse output port DPLS10 for outputting a pulse, and one A/D port CRINT. The port PWM shown in FIG. 6 is not provided in the microcomputer IC301.

The pulse output from the port DPLSVAR of the microcomputer IC301 is generated by frequency division using a digital circuit counter. A pulse having one of 256 frequencies is output from the port DPLSVAR, for example, as shown in FIG. 10. The pulse has a waveform with the ON duty varying from 25% to approximately 1%. With respect to the variations in the pulse output from the port DPLSVAR of the microcomputer IC301, the output voltage of the positive transfer voltage generator circuit 102 changes as shown in FIG. 11.

The positive transfer voltage generator circuit 102 thus has fewer components when constituted of the circuit disclosed in Japanese Patent Application Laid-Open No. H08-140351 as compared with the transfer voltage generator circuit 202 shown in FIG. 6. The transfer voltage generator circuit 301 can therefore be configured at low cost.

However, when the circuit disclosed in Japanese Patent Application Laid-Open No. H08-140351 is used as the positive transfer voltage generator circuit 102, the pulse frequency for driving the inverter transformers becomes low in the transfer voltage generator circuit 101 in a case where the required transfer voltage becomes low. An output ripple in the transfer voltage therefore becomes large. Furthermore, the digital circuit counter must be added in order to generate low frequency pulses for driving the inverter transformers.

SUMMARY OF THE INVENTION

The present invention has been made in view of the problems described above, and an object of the present invention is to provide an improved image forming apparatus.

Further, another object of the present invention is to provide a transferring apparatus including:

a transferring member applied with a transfer voltage for transferring a toner image on an image bearing member to a recording material;

a positive voltage generating portion that generates a positive-polarity voltage that is applied to the transferring member;

a negative voltage generating portion that generates a negative-polarity voltage that is applied to the transferring member; and a control portion that controls the transfer voltage applied to the transferring member, the control portion controlling the positive voltage generating portion and the negative voltage generating portion, in which:

the control portion performs control in a first mode adapted to generate the transfer voltage by superimposing the negative-polarity voltage and the positive-polarity voltage in a case where the transfer voltage applied to the transferring member is smaller than a predetermined threshold voltage; and the control portion performs control in a second mode adapted to generate the transfer voltage from the positive-polarity voltage, without superimposing the negative-polarity voltage, in a case where the transfer voltage applied to the transferring member is larger than the predetermined threshold voltage.

These and other objects, features and advantages of the present invention will become more apparent upon reading of the following detailed description along with the accompanied drawings.

DETAILED DESCRIPTION OF THE PREFERRED EMBODIMENTS

First Embodiment

Figure 1:
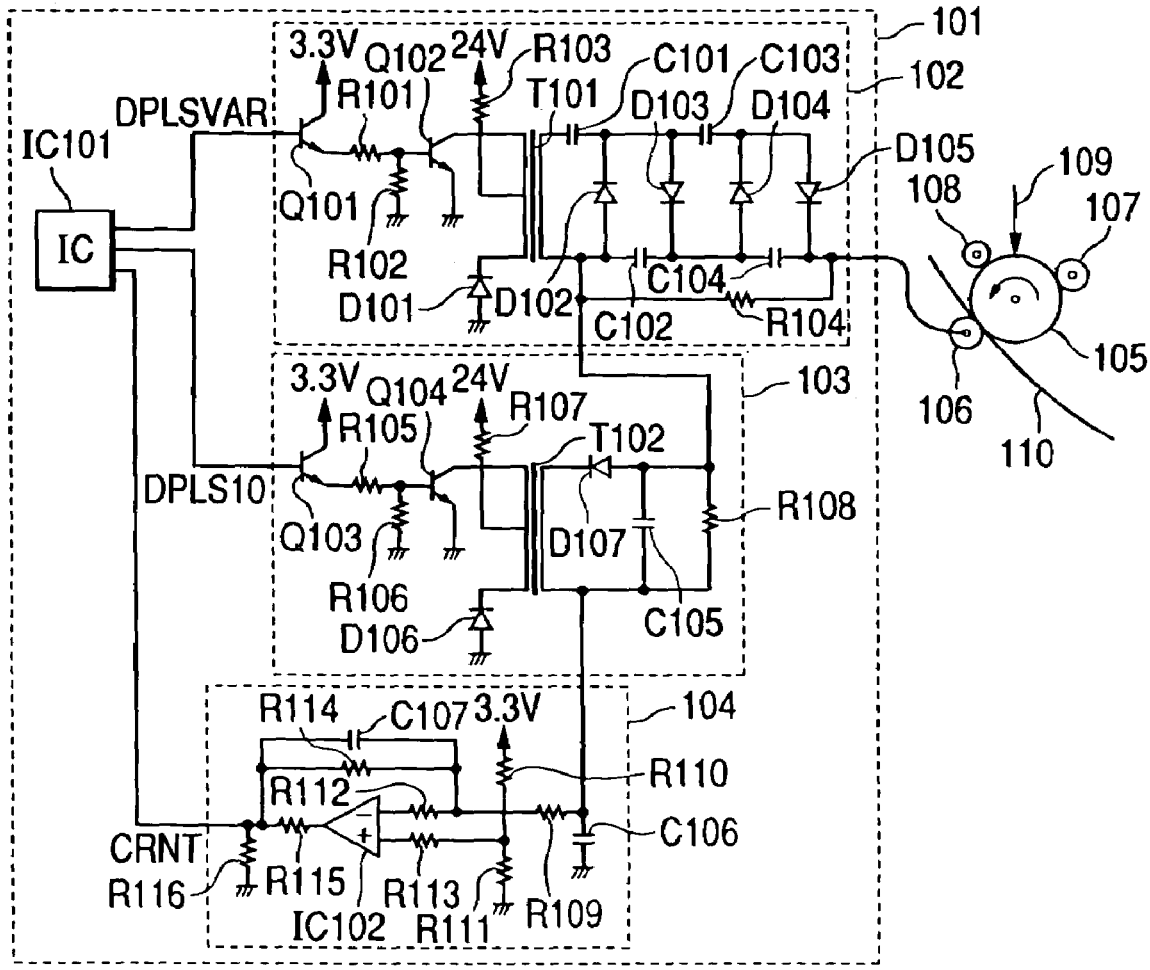
FIG. 1 is a circuit diagram that shows a configuration of a main portion of a transferring apparatus according to a first embodiment of the present invention.
Figure 9:
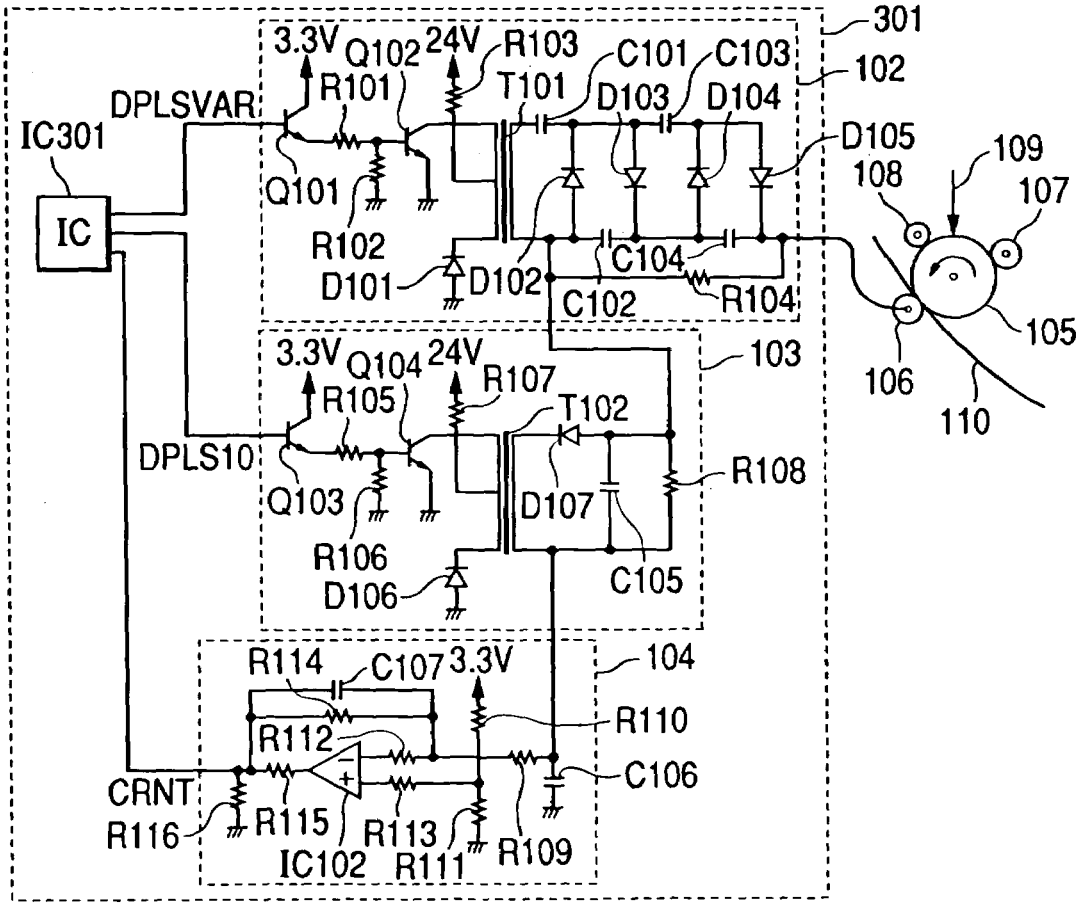
FIG. 9 is a diagram that shows a circuit configuration of a transfer voltage generator circuit that adopts the circuit disclosed in Japanese Patent Application Laid-Open No. H08-140351 as a positive transfer voltage generator circuit.

FIG. 1 is a circuit diagram that shows a configuration of a main portion of a transferring apparatus according to a first embodiment of the present invention. The circuit disclosed in Japanese Patent Application Laid-Open No. H08-140351 is used as a positive transfer voltage generator circuit in this embodiment. Elements within FIG. 1 that are identical to the circuits, components, and members shown in FIG. 9 are identified by the same reference characters as those used in FIG. 9.

A photosensitive drum 105 that is scanned and exposed by a laser light 109 is provided in an image forming apparatus as shown in FIG. 1, and the photosensitive drum 105 is grounded. A charging roller 107, a developing sleeve 108, and a transfer roller 106 are disposed in the periphery of the photosensitive drum 105. Predetermined voltages are applied to the charging roller 107 and to the developing sleeve 108 by a charging voltage generator circuit (not shown) and a developing voltage generator circuit (not shown), respectively. A transfer voltage that is output from the transfer voltage generator circuit 101 is applied to the transfer roller 106.

The photosensitive drum 105 is rotated in a direction of an arrow in FIG. 1 when forming an image, and a surface of the photosensitive drum 105 is charged uniformly to a predetermined electric potential by the charging roller 107. The surface of the photosensitive drum 105 is then scanned and exposed by the laser light 109. An electrostatic latent image is thus formed on the photosensitive drum 105. The electrostatic latent image is then made into a visible image as a toner image by toner supplied from the developing sleeve 108. The toner image being held on the photosensitive drum 105 is transferred by the transfer roller 106 onto a sheet 110 which is a recording material that is nipped and conveyed between the photosensitive drum 105 and the transfer roller 106.

The transfer voltage generator circuit 101 has the positive transfer voltage generator circuit 102, the negative transfer voltage generator circuit 103, the transfer current detector circuit 104, and the microcomputer IC101, as shown in FIG. 1.

The positive transfer voltage generator circuit 102 contains a switching portion that drives the transformer T101 based on the pulse signal from the port DPLSVAR of the microcomputer IC101, and a quadruple rectifier portion that rectifies and smoothes the output voltage of the transformer T101. The switching portion is constituted of transistors Q101 and Q102, and resistors R101, R102, and R103, and a diode D101. The resistor R103 is connected to a reference voltage source (24 V) here, and the output voltage of the transformer T101 is set by the reference voltage source. Further, the quadruple rectifier portion is constituted of capacitors C101, C102, C103, and C104, diodes D102, D103, D104, and D105, and a resistor R104. The output voltage of the rectifier portion is a positive voltage, and the output voltage is applied to the transfer roller 106, which is a load.

The negative transfer voltage generator circuit 103 specifically contains a switching portion that drives the transformer T102 based on the pulse signal from the pulse output port DPLS10 of the microcomputer IC101, and a quadruple rectifier portion that rectifies and smoothes the output voltage of the transformer T102. The switching portion is constituted of transistors Q103 and Q104, and resistors R105, R106, and R107. The resistor R107 is connected to a reference voltage source (24 V) here, and the output voltage of the transformer T102 is set by the reference voltage source.

Further, the rectifier portion is constituted of a capacitor C105, a diode D107, and a resistor R108. The output voltage of the rectifier portion is a negative voltage, and the output voltage is applied to the transfer roller 106, which is a load.

The transfer current detector circuit 104 detects the value of the current that flows in the transfer roller 106 when the positive output voltage of the positive transfer voltage generator circuit 102 is applied to the transfer roller 106. The detected current value is sent to the microcomputer IC101. The transfer current detector circuit 104 is specifically constituted of a comparative operational amplifier IC102, capacitors C106 and C107, and resistors R109, R110, R111, R112, R113, R114, R115, and R116. An output from the comparative operational amplifier IC102 is input to the microcomputer IC101 as a signal (CRNT) that shows the detected current value.

The microcomputer IC101 has one pulse output port DPLS10 that outputs a pulse, a port DPLSVAR for outputting a pulse having a fixed on-time, and an A/D port for inputting a current value detected by the transfer current detector circuit 104.

Figure 10:
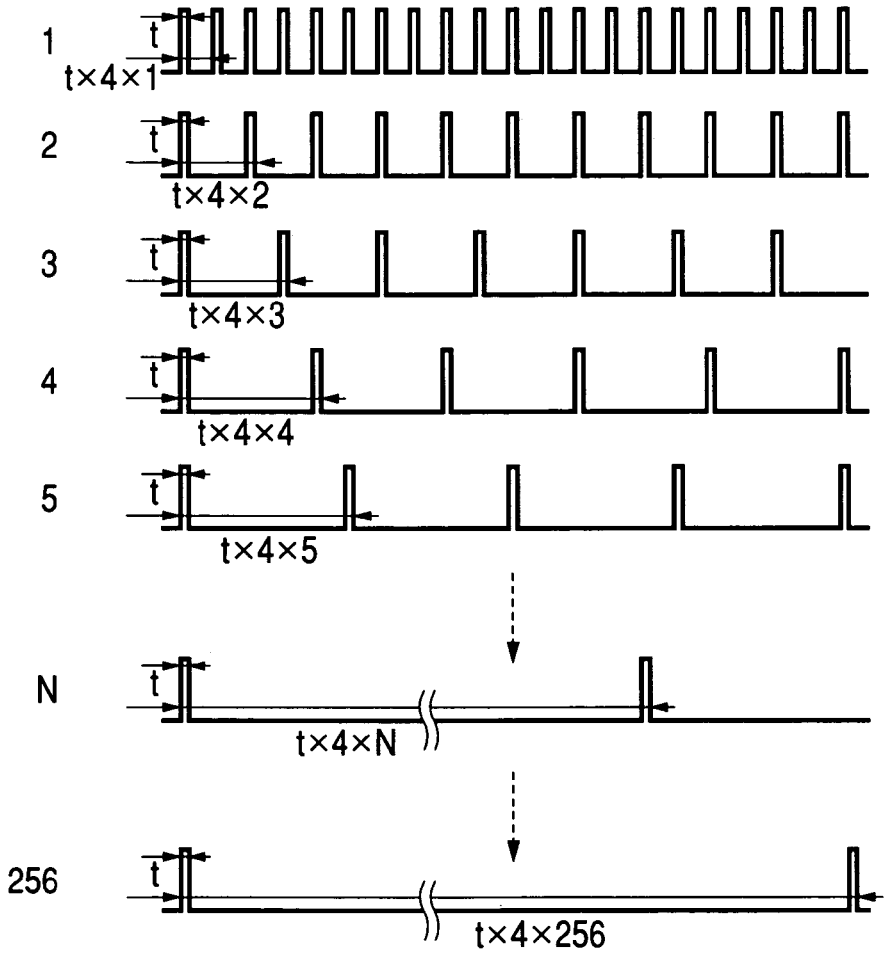
FIG. 10 shows a pulse waveform output from a port DPLSVAR of a microcomputer IC301 of FIG. 9.
Figure 11:
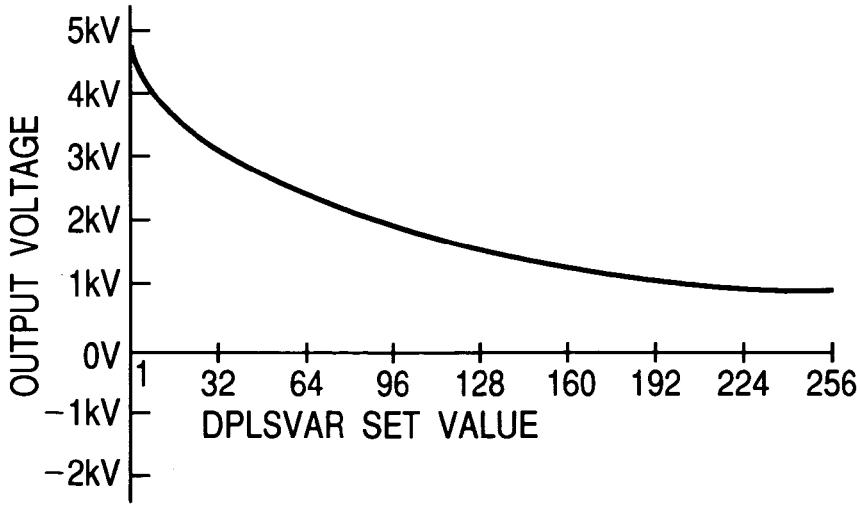
FIG. 11 is a graph that shows a relationship between an output voltage of a positive transfer voltage generator circuit 102 and the pulse output from the port DPLSVAR of the microcomputer IC301 of FIG. 9.

The pulse output from the port DPLS VAR of the microcomputer IC101 becomes a drive signal of the positive transfer voltage generator circuit 102 here, in accordance with which the inverter transformer T101 is driven. An output from the inverter transformer T101 becomes a positive transfer voltage through a latter stage quadruple rectifying circuit. That is, the microcomputer IC101 turns on the pulse output port DPLSVAR connected to the positive transfer voltage generator circuit 102 when outputting the positive transfer voltage. It should be noted that the pulse output from the port DPLSVAR of the microcomputer IC101 is generated by frequency division using a digital circuit counter. A pulse having one of 256 frequencies is output from the port DPLSVAR, for example, as shown in FIG. 10. The frequency of the pulse varies from an ON duty of 25% to approximately 0.1%. In practice, it is not necessary to vary the frequency of the pulse from an ON duty of 25% to approximately 0.1%. The frequency may be varied from an ON duty of 25% to a percentage that corresponds to a DPLSVAR set value 192 described later. It therefore becomes possible to reduce the number of frequency division circuits compared to that in the conventional art.

Further, the pulse output from the pulse output port DPLS10 becomes a drive signal of the negative transfer voltage generator circuit 103, in accordance with which the inverter transformer T102 is driven. An output of the inverter transformer T102 becomes a negative transfer voltage through a latter stage rectifier circuit. That is, the microcomputer IC101 turns on the pulse output port DPLS10 connected to the negative transfer voltage generator circuit 103 when outputting the negative transfer voltage.

In addition, the A/D port is connected to the transfer current detector circuit 104. The current value detected by the transfer current detector circuit 104 is input to the microcomputer IC101 through the A/D port, and the microcomputer IC101 determines the transfer voltage based on the current value. The pulse that is output from the port DPLSVAR and the pulse that is output from-the port DPLS10 are changed and sent to the positive transfer voltage generator circuit 102 and to the negative transfer voltage generator circuit 103, respectively, to obtain the determined transfer voltage. The drive voltage of the transformer T101 of the positive transfer voltage generator circuit 102 thus changes by this operation, and a desired output voltage (transfer voltage) is obtained.

The operations for setting the pulse that is output from the port DPLSVAR and the pulse that is output from the port DPLS10 in order to apply the desired transfer voltage to the transfer roller 106 are described below.

In the first embodiment, it is possible to perform switching between a high mode and a low mode by using the microcomputer IC101. The high mode is a mode in which the positive transfer voltage generator circuit 102 is operated independently, and in which a positive voltage generated by the positive transfer voltage generator circuit 102 is output as the transfer voltage. The low mode is a mode in which the positive transfer voltage generator circuit 102 and the negative transfer voltage generator circuit 103 are both operated, and the voltages thus generated are superimposed and output as the transfer voltage.

Figure 2:
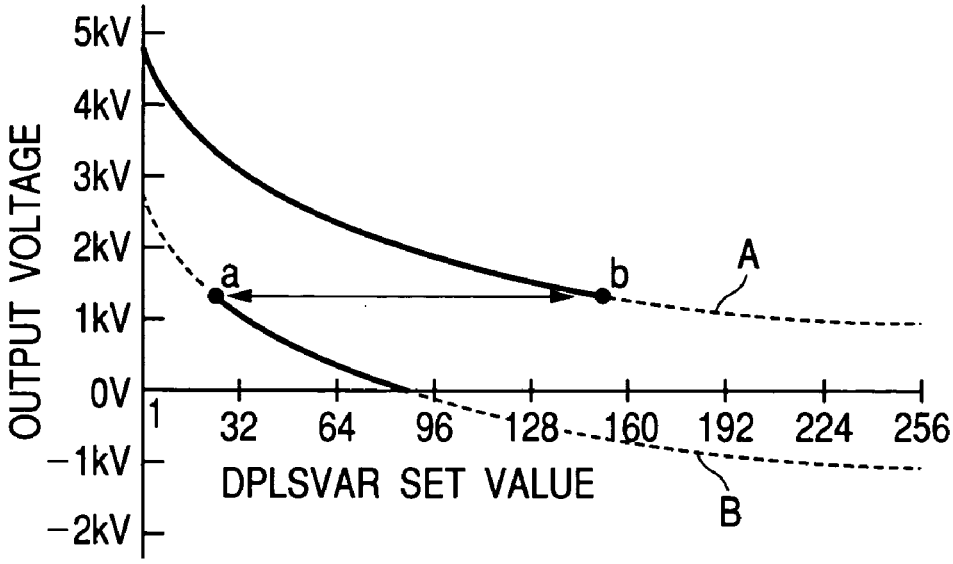
FIG. 2 is a graph that shows a relationship between a frequency (DPLSVAR set value) of a pulse output from a port DPLSVAR of a microcomputer IC101 and an output transfer voltage in a transfer voltage generator circuit 101 of FIG. 1.

Each of the modes described above will be explained while referring to FIG. 2. FIG. 2 is a diagram that shows a relationship between the frequency (DPLSVAR set value) of a pulse output from the port DPLSVAR of the microcomputer IC101 and an output transfer voltage in the transfer voltage generator circuit 101 of FIG. 1. A curve A in FIG. 1 shows a relationship between the frequency (DPLSVAR set value) of the pulse that is output from the port DPLSVAR and the output voltage (transfer voltage) when only the positive transfer voltage generator circuit 102 is operated. A curve B in FIG. 1 shows a relationship between the DPLSVAR set value and the output voltage (transfer voltage) when both the positive transfer voltage generator circuit 102 and the negative transfer voltage generator circuit 103 are operated.

The output voltage shown by the curve B (the output voltage during the low mode) becomes less than the output voltage shown by the curve A (the output transfer voltage during the high mode) by an amount equal to the output voltage of the negative transfer voltage generator circuit 103. The output voltage shown by the curve B becomes 0 V when the DPLSVAR set value is approximately 85. The transfer voltage can therefore be controlled from 0V to a maximum voltage by setting the low mode in a case where a low transfer voltage is required, and setting the high mode when a high transfer voltage is necessary, without adding any components to the circuit shown in FIG. 9.

In this embodiment, in a case where the transfer voltage is controlled by a constant current, first the microcomputer IC101 turns on the port DPLS10 and the port DPLSVAR, thus starting up the transfer voltage in the low mode. The DPLSVAR set value is set to 85 at this point. The microcomputer IC101 then reduces the DPLSVAR set value until the target current value (current detected by the transfer current detector circuit 104) is input to the A/D port of the microcomputer IC101. That is, the frequency of the pulse that is output from the port DPLSVAR is increased. Even if the DPLSVAR set value is decreased to 24, the microcomputer IC101 will switch to the high mode in a case where the detected current value does not reach a predetermined value (a point a within FIG. 2). The port DPLS10 of the negative transfer voltage generator circuit 103 therefore turns off, and the DPLSVAR set value switches to 154 (a point b in FIG. 2). The microcomputer IC101 then reduces the DPLSVAR set value until the target current value (current detected by the transfer current detector circuit 104) is input to the A/D port of the microcomputer IC101. It should be noted that whether or not the detected current value input to the microcomputer IC101 from the transfer current detector circuit 104 becomes the target current value can be determined by, for example, whether or not an inequality $Ia-\alpha<$the detected current value$<Ia+\alpha$ is satisfied, where Ia is taken as the target current value and $\alpha$ is a predetermined current value.

It should be noted that the value of the current detected by the transfer current detector circuit 104 can be changed according to the environment in which the image forming apparatus is placed, or by the operating state of each portion of the image forming apparatus, after the detected current value input to the microcomputer IC101 from the transfer current detector circuit 104 becomes the target current value. In this case as well, the DPLSVAR set value is changed according to the detected current value as described above. The microcomputer IC101 controls the DPLSVAR set value so that the predetermined target current value flows in the transfer roller 106. For example, the DPLSVAR set value is increased when a current value that is larger than the target current value Ia is input to the A/D port of the microcomputer IC101. In a case where the operating mode is the high mode at this point, and a current value that is larger than the target current value is input to the A/D port of the microcomputer IC101 even after the DPLSVAR set value reaches 154 (the point b in FIG. 2), the operating mode is switched from the high mode to the low mode. Further, the DPLSVAR value is reduced in a case where a current value that is smaller than the target current value Ia is input to the A/D port of the microcomputer IC101. In a case where the operating mode is the low mode at this point, and a current value that is smaller than the target current value is input to the A/D port of the microcomputer IC101 even after the DPLSVAR set value reaches 85 (the point a in FIG. 2), the operating mode is switched from the low mode to the high mode.

Figure 3:
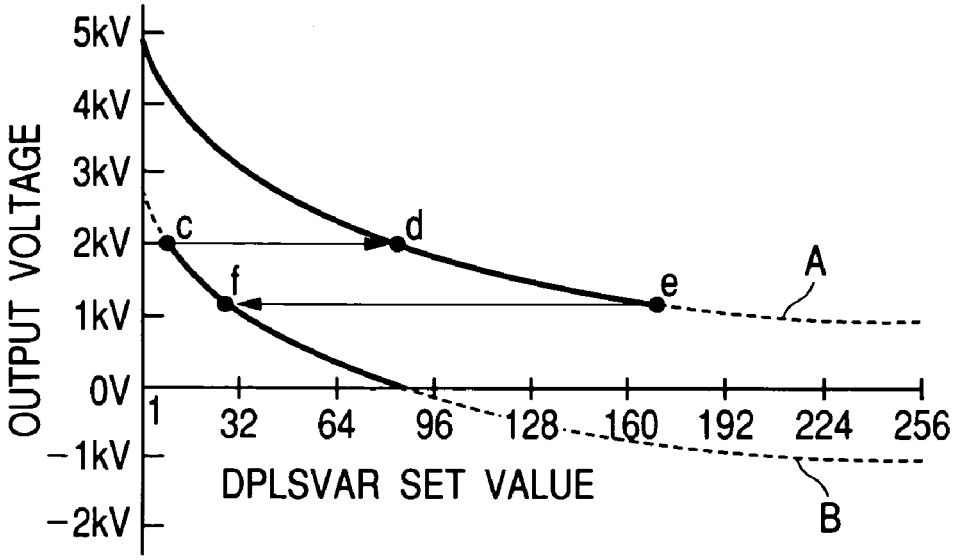
FIG. 3 is a graph that shows a relationship between the frequency (DPLSVAR set value) of the pulse output from the port DPLSVAR of the microcomputer IC101 and the output transfer voltage for a case where a hysteresis is provided in switching between a low mode and a high mode.

Further, the transfer voltage always changes under the constant current control in a case where there are resistance value irregularities in a rotary circumferential direction of the transfer roller 106. In this case it is preferable to provide a hysteresis as shown in FIG. 3 in switching between the low mode and the high mode in order to stabilize the control. FIG. 3 is a diagram that shows a relationship between the frequency (DPLSVAR set value) of the pulse output from the port DPLSVAR of the microcomputer IC101 and the output transfer voltage when a hysteresis is provided in switching between the low mode and the high mode.

In a case of switching from the low mode to the high mode in FIG. 3, the switchover to the high mode occurs at a point where the DPLSVAR set value is 8 (a point c in FIG. 3), and the DPSLVAR set value is set to 86 (a point d in FIG. 3). Further, in a case of switching from the high mode to the low mode, the switchover occurs when the DPLSVAR set value reaches 175 (a point e in FIG. 3), and the DPLSVAR set value is set to 28 (a point f in FIG. 3).

It should be noted that, although the control modes of the transferring apparatus (the low mode and the high mode) by the microcomputer IC101 explained above are control modes in a case of transferring a toner image on the photosensitive drum 105 to the recording material sheet 110, a cleaning mode for cleaning the transfer roller 106 also exists as another control mode.

As described above, the transfer roller may be contaminated by toner when a set remains within the apparatus and the sheet is removed manually or the like. In the cleaning mode, the microcomputer IC101 performs a control so that a voltage having the same polarity as the toner polarity (negative polarity) is applied from the negative transfer voltage generator circuit 103 to the transfer roller 106, causing the toner on the transfer roller 106 to transit to the photosensitive drum 105. It should be noted that the microcomputer IC101 performs a control in the cleaning mode so that a positive-polarity voltage, which has the opposite polarity to that of the toner polarity (negative polarity) is not applied from the positive transfer voltage generator circuit 102 to the transfer roller 106.

Switching thus occurs in this embodiment between the mode in which the positive transfer voltage generator circuit 102 is operated independently, and the mode where the positive transfer voltage generator circuit 102 and the negative transfer voltage generator circuit 103 are both operated together. Therefore, even in a case when a required transfer voltage is low, the required low transfer voltage can be generated by employing a low cost circuit configuration, without making a ripple larger.

Second Embodiment

Figure 4:
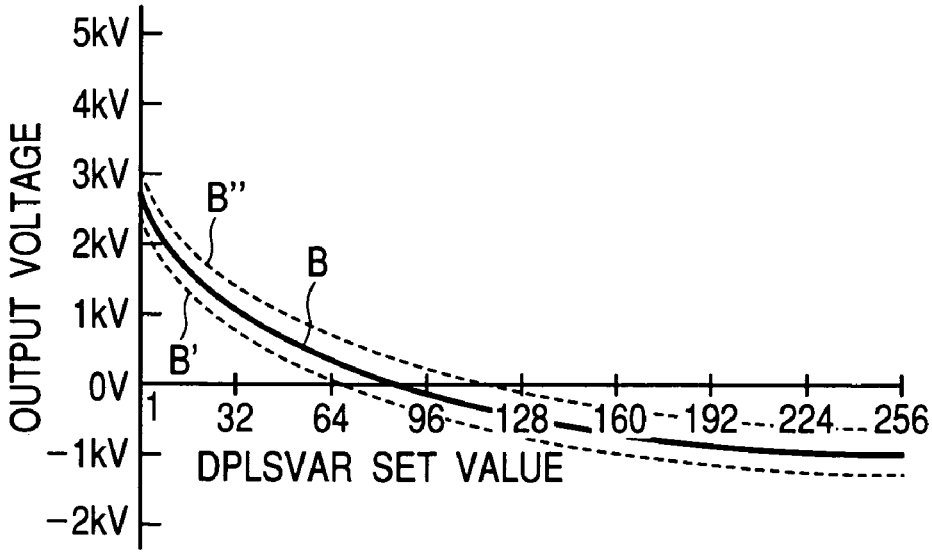
FIG. 4 is a graph that shows a relationship between an output voltage of a negative transfer voltage generator circuit 103, and the frequency (DPLSVAR set value) of the pulse output from the microcomputer IC101, when the output voltage is not constant in a transferring apparatus according to a second embodiment of the present invention.
Figure 5:
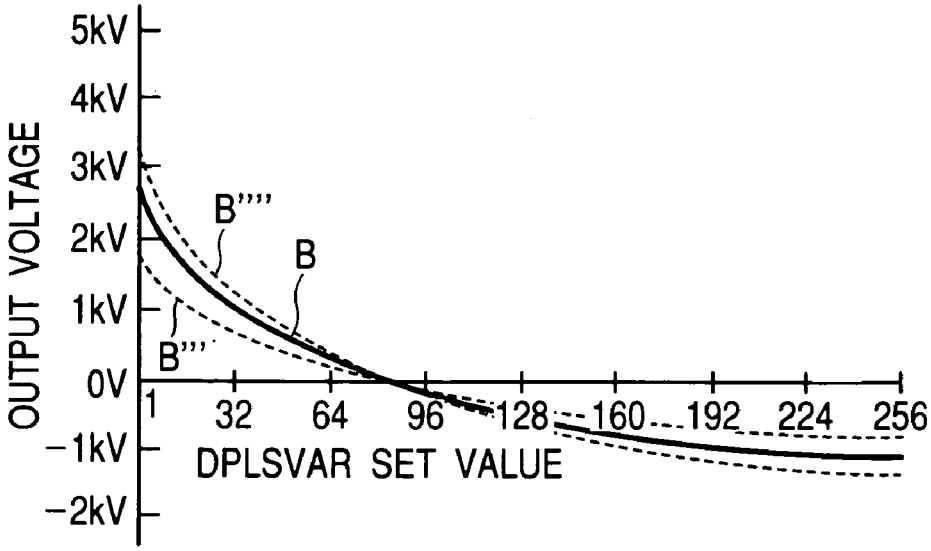
FIG. 5 is a graph that shows a relationship between the output voltage and the frequency (DPLSVAR set value) of the pulse output from the microcomputer IC10l when there is load variation in the transferring apparatus according to the second embodiment of the present invention.
Figure 6:
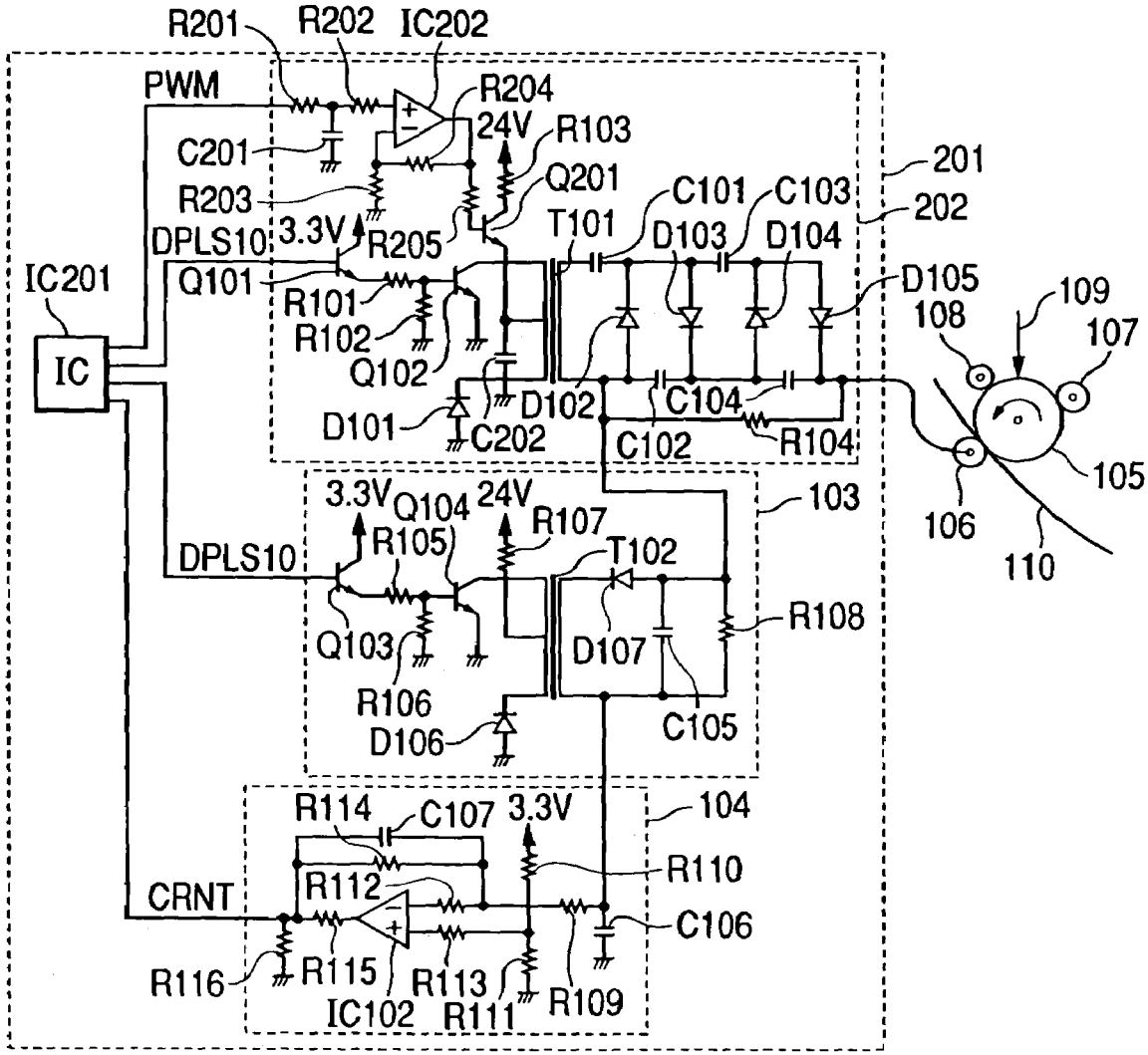
FIG. 6 is a schematic diagram that shows a transfer voltage generator circuit for a case where a toner is a negative toner.
Figure 7:
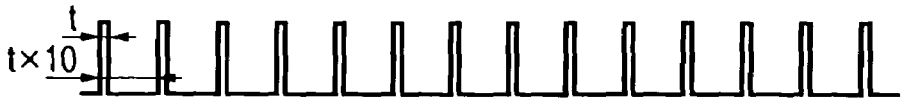
FIG. 7 shows a pulse waveform that is output from a pulse output port DPLS10 of a microcomputer IC201 of FIG. 6.
Figure 8:
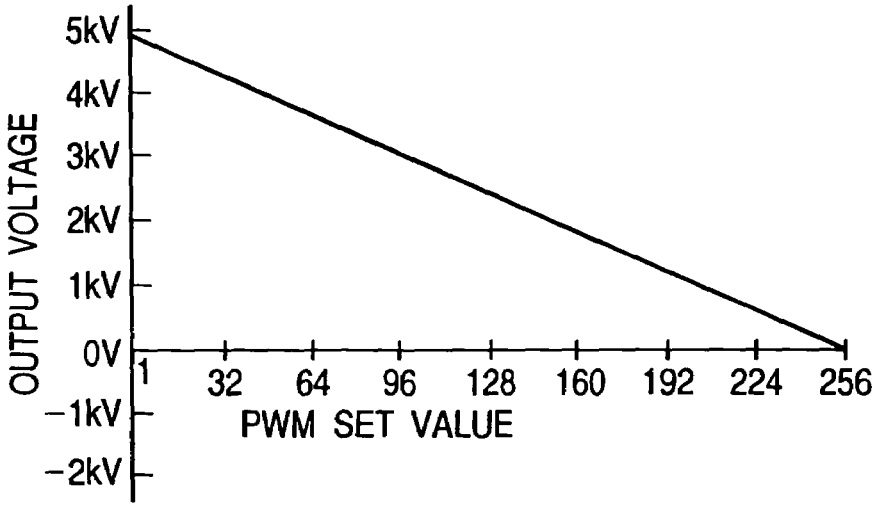
FIG. 8 is a graph that shows a relationship between an output voltage of a positive transfer voltage generator circuit 202 and a PWM signal output from the microcomputer IC201 of FIG. 6.

A second embodiment of the present invention is explained next while referring to FIGS. 4 and 5. FIG. 4 is a diagram that shows a relationship between an output voltage of the negative transfer voltage generator circuit 103, and the frequency (DPLSVAR set value) of the pulse output from the port DPLSVAR of the microcomputer IC101, when there is variation in the output voltage in a transferring apparatus according to the second embodiment of the present invention. FIG. 5 is a diagram that shows a relationship between the output voltage and the frequency (DPLSVAR set value) of the pulse output from the microcomputer IC101 when there is load variation in the transferring apparatus according to the second embodiment of the present invention.

A case of controlling the transfer voltage by constant current control is explained in the first embodiment described above. a DPLSVAR set value at which the voltage output during the low mode becomes 0 V is very important for systems in which the transfer voltage is determined by computing the voltage during constant current control after the transfer voltage is controlled by constant current control. This is because, from the start, high precision is not necessary for outputting the output voltage of the negative transfer voltage circuit 103, and a relationship between the DPLSVAR set value in the low mode and the output voltage is not uniqueely determined due to large variations in the output voltage. Therefor, if the DPLSVAR set value that gives an output voltage of 0 V in the low mode is known in advance, a correction can be incorporated into the relationship between the DPLSVAR set value and the output voltage, and the output voltage can be found from the DPLSVAR set value.

In the low mode the relationship between the output voltage and the DPLSVAR set value when there is variation in the output voltage of the negative transfer voltage generator circuit 103 is as shown in FIG. 4, for example. A curve B in FIG. 4 shows a standard relationship, and curves B' and B" each show a relationship in which there is a deviation in the output voltage of the negative transfer voltage generator circuit 103. The DPLSVAR set value that makes the output voltage 0 V becomes 64 for the case of the curve B', and becomes 112 for the case of the curve B".

As shown by the curves B' and B", the relationships denoted by the curves B' and B" only shift up and down with respect to the standard relationship shown by the curve B when the output voltage of the negative transfer voltage generator circuit 103 has a deviation. Therefore, in a case where the output voltage is estimated when performing constant current control, it is easy to correct the transfer voltage by using a DPLSVAR set value at which the output voltage becomes 0 V.

The DPLSVAR set value at which the output voltage becomes 0 V can be set as a value at which the transfer current value detected by the transfer current detector circuit 104 becomes 0 A. The detection operation is performed by setting the target current value Ia for the detected current to 0 in the first embodiment. The DPLSVAR set value is made smaller in a case where the detected current value is smaller than the target current value, and the DPLSVAR set value is made larger in a case where the detected current value is larger than the target current value. Then, when the detected current value becomes the target current value (for example, in a case when the inequality Ia−α<the detected current value<Ia+α is satisfied, where Ia is taken as the target current value and α is a predetermined current value), the DPLSVAR set value that is set at that time is stored in a memory (not shown) that is provided to the microcomputer IC101 or the like. The stored DPLSVAR set value is a value at which the transfer voltage is 0 V, and therefore the DPLSVAR set value can be set to this value when applying a desired transfer voltage based on this value. It should be noted that the transfer current is not influenced by the state of the photosensitive drum 105 at this time. Accordingly, it is necessary to perform the detection described above according to predetermined conditions. This is discussed later.

Further, the slope of the curve B changes when there is variation in the resistance value of the transfer roller 106, that is, when there is variation in load. However, the transfer current is 0 A when the transfer voltage is 0 V, regardless of the load, and therefore the DPLSVAR set value at which the transfer voltage becomes 0 V in the low mode does not change. In a case where the load in the low mode changes from the standard value, the relationships between the transfer voltage and the DPLSVAR set value become relationships like those shown by curves B''' and B'''' of FIG. 5. In this case the curve B changes, and therefore it is necessary to predict the changes in the curve B in advance according to the load variation, and correct the output voltage from the DPLSVAR set value during constant current control. However, the DPLSVAR set value at which the transfer voltage becomes 0 V does not change, and it is thus not necessary to consider this point.

The conditions described above for detecting the DPLSVAR set value at which the transfer voltage becomes 0 V will be explained. There are no problems when detecting the DPLSVAR set value at which the transfer voltage becomes 0 V, provided that the electric potential on the photosensitive drum 105 is the same as the ground electric potential. The photosensitive drum 105, however, is not limited to always being in that state. At a minimum, the transfer voltage will not become 0 V, even if the transfer current value is 0 A, in a case where a surface that is charged by the charging roller 107 contacts the transfer roller 106. This is because charges on the photosensitive drum 105 flow to the transfer roller 106 when the charged photosensitive drum 105 contacts the transfer roller 106. Accordingly, it is necessary that a surface of the photosensitive drum 105 that contacts the transfer roller 106 be not charged by the charging roller 107 when detecting the DPLSVAR set value at which the transfer voltage becomes 0 V. Furthermore, charges on the photosensitive drum 105 dissipate by irradiating the laser light 109 to the photosensitive drum 105. It is therefore preferable to detect the DPLSVAR set value at which the transfer voltage becomes 0 V at a timing where a surface of the photosensitive drum 105 that has been irradiated by the laser light 109 contacts the transfer roller 106.

Further, the sheet 110 is, of course, not allowed to be present between the transfer roller 106 and the photosensitive drum 105 when detecting the DPLSVAR set value at which the transfer voltage becomes 0 V.

The process for developing a toner image on the photosensitive drum 105 by reversal development is explained above. It should be noted that reversal development is a development process in which toner that is charged with the same polarity as the polarity of an electrostatic latent image adheres to regions of the latent image having a small electric potential absolute value, thus visualizing the latent image. With the reversal development process, negative-polarity toner adheres to the electrostatic latent image on the photosensitive drum 105, and a positive-polarity transfer voltage is applied to the transfer roller 106, thus transferring the toner on the photosensitive drum 105 to the sheet 110. The microcomputer IC101 performs a control so that a positive-polarity voltage and a negative-polarity voltage are superimposed, generating a transfer voltage, in a case where the transfer voltage applied to the transfer roller 105 has an absolute value that is smaller than a predetermined threshold voltage. The microcomputer IC101 performs a control so that the transfer voltage is generated from a positive-polarity voltage, without superimposing a negative-polarity voltage, in a case where the transfer voltage applied to the transfer roller 105 has an absolute value that is larger than the predetermined threshold voltage.

On the other hand, the present invention is also applicable to a process in which a toner image is developed on the photosensitive drum 105 by normal development.

It should be noted that normal development is a development process in which toner that is charged with a polarity that is opposite to the polarity of an electrostatic latent image adheres to regions of the latent image having a large electric potential absolute value, thus visualizing the latent image. With the normal development process, positive-polarity toner adheres to the electrostatic latent image on the photosensitive drum 105, and a negative-polarity transfer voltage is applied to the transfer roller 106, thus transferring the toner on the photosensitive drum 105 to the sheet 110. The microcomputer IC101 performs a control so that a positive-polarity voltage and a negative-polarity voltage are superimposed, generating a transfer voltage, in a case where the transfer voltage applied to the transfer roller 105 has an absolute value that is smaller than a predetermined threshold voltage. Alternatively, the microcomputer IC101 performs a control so that the transfer voltage is generated from a negative-polarity voltage, without superimposing a positive-polarity voltage, in a case where the transfer voltage applied to the transfer roller 105 has an absolute value that is larger than the predetermined threshold value.

It should be noted that the present invention is not limited to the embodiments described above. Various modifications may be made within the scope of the appended claims.

What is claimed is:

1. A transferring apparatus comprising:

a transferring member applied with a transfer voltage for transferring a toner image on an image bearing member to a recording material;

a positive voltage generating portion that generates a positive-polarity voltage that is applied to the transferring member;

a negative voltage generating portion that generates a negative-polarity voltage that is applied to the transferring member; and a control portion that controls the transfer voltage applied to the transferring member, the control portion controlling the positive voltage generating portion and the negative voltage generating portion, wherein the control portion performs control in a first mode adapted to generate the transfer voltage by superimposing the negative-polarity voltage and the positive-polarity voltage in a case where the transfer voltage applied to the transferring member is smaller than a predetermined threshold voltage, and wherein the control portion performs control in a second mode adapted to generate the transfer voltage from the positive-polarity voltage, without superimposing the negative-polarity voltage, in a case where the transfer voltage applied to the transferring member is larger than the predetermined threshold voltage.

2. A transferring apparatus according to claim 1, wherein the control portion performs control to apply the negative-polarity voltage to the transferring member, without superimposing the positive-polarity voltage, in a case where the toner on the transferring member is transited to the image bearing member.

3. A transferring apparatus according to claim 1, wherein the negative voltage generating portion generates the constant negative-polarity voltage, and wherein the positive voltage generating portion generates the positive-polarity voltage that is variable according to a control signal from the control portion.

4. A transferring apparatus according to claim 3, further comprising a transfer current detector portion that detects a transfer current flowing in the transferring member, wherein the control portion controls the transfer voltage such that the transfer current detected by the transfer current detector portion becomes a predetermined target current.

5. A transferring apparatus according to claim 4, further comprising a storage portion that stores information relating to the control signal in a case where the transfer current detected by the transfer current detector portion is the predetermined current, wherein the control portion controls the transfer voltage based on the information relating to the control signal that is stored in the storage portion.

6. A transferring apparatus according to claim 5, wherein the case where the transfer current is the predetermined current includes a case where the transfer current does not flow in the transferring member.

7. A transferring apparatus comprising:

a transferring member applied with a transfer voltage for transferring a toner image on an image bearing member to a recording material;

a positive-voltage generating portion that generates a positive-polarity voltage that is applied to the transferring member;

a negative-voltage generating portion that generates a negative-polarity voltage that is applied to the transferring member; and a control portion that controls the positive-polarity generating portion and the negative-polarity generating portion, the control portion performing control in a first mode where the transfer voltage is generated by superimposing the negative-polarity voltage and the positive-polarity voltage, and in a second mode where the transfer voltage is generated from the positive-polarity voltage without superimposing the negative-polarity voltage, wherein the control portion switches from the first mode to the second mode in a case where the transfer voltage applied to the transferring member is changed into a voltage that is larger than a predetermined threshold voltage from a voltage that is smaller than the predetermined threshold voltage, and wherein the control portion switches from the second mode to the first mode in a case where the transfer voltage applied to the transferring member is changed into a voltage that is smaller than a predetermined threshold voltage from a voltage that is larger than the predetermined threshold voltage.

8. A transferring apparatus according to claim 7, wherein the predetermined threshold voltage in a case of switching from the first mode to the second mode is larger than the predetermined threshold voltage in a case of switching form the second mode to the first mode.

9. A transferring apparatus according to claim 7, wherein the control portion performs control to apply the negative-polarity voltage to the transferring member, without superimposing the positive-polarity voltage, in a case where the toner on the transferring member is transited to the image bearing member.

10. A transferring apparatus according to claim 7, wherein the negative voltage generating portion generates the constant negative-polarity voltage, and wherein the positive voltage generating portion generates the positive-polarity voltage that is variable according to a control signal from the control portion.

11. A transferring apparatus according to claim 10, further comprising a transfer current detector portion that detects a transfer current flowing in the transferring member, wherein the control portion controls the transfer voltage such that the transfer current detected by the transfer current detector portion becomes a predetermined target current.

12. A transferring apparatus according to claim 11, further comprising a storage portion that stores information relating to the control signal in a case where the transfer current detected by the transfer current detector portion is the predetermined current, wherein the control portion controls the transfer voltage based on the information relating to the control signal that is stored in the storage portion.

13. A transferring apparatus according to claim 12, wherein the case where the transfer current is the predetermined current includes a case where the transfer current does not flow in the transferring member.

14. A transferring apparatus comprising:

a transferring member applied with a transfer voltage for transferring a toner image on an image bearing member to a recording material;

a first voltage generating portion that generates a voltage having a predetermined polarity, which is applied to the transferring member;

a second voltage generating portion that generates a voltage having a polarity opposite to the predetermined polarity, which is applied to the transferring member; and a control portion that controls the transfer voltage applied to the transferring member, the control portion controlling the first voltage generating portion and the second voltage generating portion, wherein the control portion has a first control mode where the transfer voltage is generated by superimposing the voltage of the predetermined polarity and the voltage of the opposite polarity, and a second control mode where the transfer voltage is generated from the voltage of the predetermined polarity without superimposing the voltage of the opposite polarity.

* * * * *

UNITED STATES PATENT AND TRADEMARK OFFICE

CERTIFICATE OF CORRECTION

PATENT NO. : 7,020,407 B2
APPLICATION NO. : 10778064
DATED : March 28, 2006
INVENTOR(S) : Yasuhiro Nakata et al.

It is certified that error appears in the above-identified patent and that said Letters Patent is hereby corrected as shown below:

COLUMN 1:

Line 52, “negative” should read -- a negative--.

COLUMN 7:

Line 58, “from-the” should read --from the--.

COLUMN 10:

Line 28, “a” should read --A--; and
Line 37, “uniqueely” should read --uniquely.--.

COLUMN 14:

Line 10, “form” should read --from--.

Signed and Sealed this

Nineteenth Day of September, 2006

JON W. DUDAS
*Director of the United States Patent and Trademark Office*